United States Patent [19]

Starkenberg et al.

[11] Patent Number: 4,545,829

[45] Date of Patent: Oct. 8, 1985

[54] EMULSION SYNTHESIZED COMPOSITE HIGH EXPLOSIVES

[75] Inventors: John J. Starkenberg, Owings Mills; Gould Gibbons, Jr., Finksburg, both of Md.

[73] Assignee: The United States of America as represented by the Secretary of the Army, Washington, D.C.

[21] Appl. No.: 630,800

[22] Filed: Jul. 13, 1984

[51] Int. Cl.[4] ..... D03D 23/00

[52] U.S. Cl. ..... 149/109.6; 149/55; 149/57; 149/76; 149/105

[58] Field of Search ..... 149/109.6, 105, 55, 149/57, 76

[56] References Cited

U.S. PATENT DOCUMENTS 3,994,756 11/1976 Hendrickson et al. ..... 149/18

*Primary Examiner*—Stephen J. Lechert, Jr.

*Attorney, Agent, or Firm*—Anthony T. Lane; Robert P. Gibson; Edward F. Costigan

[57] ABSTRACT

A process of making mixed, stable explosives from emulsions, the resulting composite having a greater degree of energy available for release.

24 Claims, No Drawings

EMULSION SYNTHESIZED COMPOSITE HIGH EXPLOSIVES

GOVERNMENTAL INTEREST

The invention described herein may be manufactured, used and licensed by or for the Government for Governmental purposes without payment to us of any royalties thereon.

BACKGROUND OF THE INVENTION

1. Field of Use

This invention relates to improved procedures for producing composite explosives from emulsions. More particularly, this invention relates to procedures for producing an emulsion of explosives and oxidizers which may be processed and shaped into explosive composites having more energy available for release than that of the known art.

2. Description of Prior Art

The crystalline explosives, particularly trinitrotoluene (TNT) are highly under-oxidized, thus offering the potential for increased energy release with the addition of one or more oxidants to form a composite material. It is now known that it is possible to produce a composite explosive which outperforms composition B. This may be accomplished, for example, with ammonium perchlorate.

Practical realization of performance approximating the theoretical prediction requires a sufficiently intimate mix between the components of the composite explosive. Intimacy implies small particle size and integration of the components. Two techniques dominate the present state of the art of producing such intimate mixes: milling to fine particle size and the formation of eutectics. Mills of various designs can produce particle sizes which are quite small, but particle size alone does not ensure intimacy. Adequate mixing must also be accomplished and the product must be stabilized to prevent segregation of the components during storage. While the use of eutectics leads to high levels of intimacy and stable products, the approach is limited to those materials which naturally form eutectics. Such materials do not ordinarily represent optimum formulations.

SUMMARY OF THE INVENTION

It is an object of this invention to provide a process of making composite explosives which have a controlled degree of intimacy for greater energy release upon detonation.

Obtaining control over the degree of intimacy allows tailoring of explosive performance to specific application. Since component selection is only weakly dependent on the procedures and alternative procedures are specified, components representing optimum formulations may readily be used. The final product is automatically stabilized since it consists of discrete microscopic units containing the components bonded together in the desired proportions.

The present invention encompasses techniques for producing intimately mixed, stable composite explosives from emulsions. The outer component of the emulsion may be either the fuel (crystalline explosive), the oxidant (e.g., ammonium nitrate, ammonium perchlorate,) or a carrier for either (e.g., water, alcohol) which is subsequently removed. The emulsion may be produced by mechanical means, by use of a surfactant, or may be mechanically produced and surfactant stabilized. Mechanical production refers to the use of a commercially available homogenizer. An almost endless variety of surfactants are commercially available. See Detergents: Emulsifiers, 1983 Annual, McCutcheon (ed), Allured Publishing Corp., Ridgewood, N.J. Surfactants are selected for compatibility with the explosive components and to control the particle size of the inner component. Particle size control is also obtained through adjustment of the homogenizer. Two distinct types of products may be generated as described in the following paragraphs.

A molten emulsion of fuel in oxidant or oxidant in fuel is produced by any of the means described in the foregoing discussion. Surfactants and/or emulsifying machinery are selected to produce the desired intimacy. The molten emulsion is then cast into the desired configuration. Upon freezing the intimacy properties of the emulsion are permanently stabilized and solid products result. These consist of fuel particles in an oxidant matrix or oxidant particles in a fuel matrix. The selection of fuel or oxidant as the inner component is dictated by the formulation and particle size desired. For a given ratio of fuel to oxidant and a given particle size the selection of one or the other as the inner component will result in more satisfactory intimacy properties.

When the high melting point of one of the components renders production of a molten emulsion impractical, the low melting point component is emulsified in a saturated solution of the high melting point component in a suitable solvent. Many of the common oxidants (e.g., ammonium nitrate, ammonium perchlorate) are highly water soluble making this a desirable approach. The solvent is then removed by a spray evaporation process using commercially available equipment. In this case, surfactants are used to control particle size, stabilize the emulsion, and cause the solute to migrate and bond to the inner component upon freezing and precipitation in the spray drying process. The surfactant continues to act to stabilize the composition of the final product which consists of integral fuel-oxidant units.

DESCRIPTION OF THE PREFERRED EMBODIMENTS

A. Amatol (60% ammonium nitrate/40% TNT) with TNT matrix. 12% more energetic than TNT. Procedure per 100 lb. batch:

1. Melt 40 lbs. of TNT in kettle and raise temperature to 170° C.
2. Add 1 lb. of surfactant SPAN-65 (sorbitan tristerate) or equivalent.
3. Add 60 lbs. of ammonium nitrate while stirring.
4. Continue stirring until emulsion of ammonium nitrate in TNT has formed.
5. Cast in desired configuration.

B. Amatol (60% ammonium nitrate/40% TNT) with ammonium nitrate matrix. 12% more energetic than TNT. Procedure per 100 lbs. batch:

1. Melt 40 lbs of TNT in kettle and raise temperature to 170° C.
2. Add 1 lb. of surfactant TWEEN-40 (polyoxyalkylene derivative of sorbitan monopalmitate or equivalent.
3. Add 60 lbs. of ammonium nitrate while stirring.
4. Continue stirring until emulsion of TNT in ammonium nitrate has formed.
5. Cast in desired configuration.

C. Amatol (60% ammonium nitrate/40% TNT) ammonium nitrate coated TNT powder. 12% more energetic than TNT. Procedure per 100 lbs. batch:

1. Dissolve 60 lbs. of ammonium nitrate in sufficient water at 90° C.
2. Add 40 lbs. of powdered TNT while stirring and allow to melt.

3a. Add 5 lbs of surfactant (the cited TWEEN-40 or equivalent) and/or

3b. Homogenize using a homogenizer, Cherry Burell Co., Cedar Rapids, Iowa.

4. Immediately spray dry using spray dry equipment, Niro Co., Columbia, Md.
5. Press or remelt and cast as desired.

D. Ammonium Perchlorate/TNT Composite (60% ammonium perchlorate/40% TNT) ammonium perchlorate coated TNT powder. 40% more energetic than TNT and 14% more energetic than composition B. Procedure per 100 lbs. batch:

1. Dissolve 60 lbs. of ammonium perchlorate in sufficient water at 90° C.
2. Add 40 lbs. of powdered TNT while stirring and allow to melt.

3a. Add 5 lbs of surfactant (the cited TWEEN-40 or equivalent) and/or

3b. Homogenize using the cited Cherry Burell homogenizer.

4. Immediately spray dry using the cited NIRO spray dry equipment or equivalent.
5. Press or remelt and cast as desired.

The manufacturing processes described produce the high level of intimacy required to obtain optimum performance from a composite explosive. Further, the composite explosive thus produced has a uniform composition on a microscopic scale. Also, the use of homogenizers and surfactants allow control of the particle size and intimacy properties of the final product. This in turn permits the production of explosives tailored to specific applications. Thus, the performance of conventional composite explosives is improved due to the improved intimacy properties thus obtained. In addition, new fuel/oxidant compositions which provide performance superior to conventional explosives can be formulated and, low sensitivity components can be used to yield high performance composite explosives. Stability of the final product is inherent in the manufacturing process. Thus, no additional processing is required to obtain a product which does not segregate during storage. Another advantage is that low cost components with broad production bases can be successfully exploited. And, the manufacturing processes described involve the use of commercially available surfactants, homogenizers, and spray dryers and may be readily automated.

Explosive composites produced by these procedures are suitable for use in fragmenting warheads. In addition, however, these explosives are sufficiently precise in their behavior to be used in precision shaped charges and in explosive logic circuits.

What is claimed is:

1. In a process of making composites of high explosives consisting of a crystalline explosive component and an oxidizer component, the improvement consisting essentially of melting the lower melting point crystalline explosive, adding a surfactant to said molten explosive, raising the temperature to within 5° C. above the melting point of the higher melting point oxidizer, incorporating particles of said oxidizer into said molten explosive while stirring until an emulsion is formed, casting said emulsion into a shaped explosive composite.

2. The process of claim 1 wherein said crystalline explosive forms the outer component of said emulsion.

3. The process of claim 1 wherein said oxidizer forms the outer component of said emulsion.

4. The process of claim 2 wherein said crystalline explosive is TNT and said oxidizer is ammonium nitrate.

5. The process of claim 3 wherein said crystalline explosive is TNT, and said oxidizer is ammonium nitrate.

6. The process of claim 4 wherein a ratio of 40 pounds of TNT, 60 pounds of ammonium nitrate and 1 pound of surfactant is used.

7. The process of claim 5 wherein a ratio of 40 pounds of TNT, 60 pounds of ammonium nitrate and 1 pound of surfactant is used.

8. The process of claim 6 wherein said surfactant is sorbitan tristerate.

9. The process of claim 7 wherein said surfactant is a polyalkylene derivative of sorbitan monopalmitate.

10. In a process of making composite high explosives consisting of a crystalline explosive component and an oxidizer component, the improvement consisting essentially of dissolving the higher melting point oxidizer in a liquid solvent heated to within 5° C. above the melting point of the lower melting point crystalline explosive, adding particles of said crystalline explosive to said heated solution while stirring until said crystalline explosive has melted forming a fluidized mass, emulsifying said fluidized mass, spray drying said emulsion to remove said solvent and form a powdered product of oxidizer coated crystalline explosive particles, shaping said powdered product into an explosive composite.

11. The process of claim 10 wherein said emulsion is formed using a homogenizer.

12. The process of claim 10 wherein said emulsion is formed using a surfactant.

13. The process of claim 10 wherein said emulsion is formed using a homogenizer and stabilized using a surfactant.

14. The process of claim 11 wherein said crystalline explosive is TNT, said oxidizer is ammonium nitrate and said solvent is water.

15. The process of claim 11 wherein said crystalline explosive is TNT, said oxidizer is ammonium perchlorate and said solvent is water.

16. The process of claim 12 wherein said crystalline explosive is TNT, said oxidizer is ammonium nitrate and said solvent is water.

17. The process of claim 13 wherein said crystalline explosive is TNT, said oxidizer is ammonium nitrate and said solvent is water.

18. The process of claim 12 wherein said crystalline explosive is TNT, said oxidizer is ammonium perchlorate and said solvent is water.

19. The process of claim 14 wherein a ratio of 40 pounds of said TNT and 60 pounds of said oxidizer is used.

20. The process of claim 15 wherein a ratio of 40 pounds of said TNT and 60 pounds of said oxidizer is used.

21. The process of claim 16 wherein a ratio of 40 pounds of said TNT and 60 pounds of said oxidizer is used.

22. The process of claim 18 wherein a ratio of 40 pounds of said TNT and 60 pounds of said oxidizer is used.

23. The prosess of claim 21 wherein said surfactant is a polyalkylene derivative of sorbitan monopalmitate.

24. The process of claim 13 wherein said crystalline explosive is TNT, said oxidizer is ammonium perchlorate, and said solvent is water.

* * * * *